United States Patent [19]

Preuss et al.

[11] 4,015,522

[45] Apr. 5, 1977

[54] MULTICOLOR SHEET-FED PRINTING PRESS

[75] Inventors: Friedrich Preuss, Sprendlingen; Kurt Difflipp, Dietzenbach, both of Germany

[73] Assignee: Roland Offsetmaschinenfabrik Faber & Schleicher AG, Germany

[22] Filed: May 26, 1976

[21] Appl. No.: 690,177

[30] Foreign Application Priority Data

May 28, 1975 Germany ..... 2523662

[52] U.S. Cl. ..... 101/183; 101/230

[51] Int. Cl.[2] ..... B41F 7/06

[58] Field of Search ..... 101/183, 184, 185, 177, 101/174, 136, 137, 140, 141, 142, 144, 232, 230, 231; 271/225, 197, 82

[56] References Cited

UNITED STATES PATENTS

| | | | |
|---|---|---|---|
| 2,702,002 | 2/1955 | Koch | 101/136 |
| 2,757,610 | 8/1956 | Gegenheimer et al. | 101/183 |
| 3,158,092 | 11/1964 | Barthel | 101/183 X |
| 3,537,391 | 11/1970 | Mowry | 101/183 |
| 3,742,847 | 7/1973 | Zimmermann et al. | 101/230 |
| 3,796,154 | 3/1974 | Weisgerber | 101/232 |

*Primary Examiner*—J. Reed Fisher

*Attorney, Agent, or Firm*—Leydig, Voit, Osann, Mayer & Holt, Ltd.

[57] ABSTRACT

A sheet-fed printing press installation comprised of a first press unit for printing on one side of a sheet and which is coupled by a chain type conveyor to a second press unit in which there is a transfer drum having a normal set of grippers and an auxiliary set of grippers for (a) additional printing on the same side of the sheet or (b) printing on the opposite side of the sheet. The conveyor has an inlet sprocket for taking of the sheet from the impression cylinder in the first press unit and an outlet sprocket for delivering the sheet to the impression cylinder in the second press unit. First and second transfer drums are interposed in series between the outlet sprocket and the impression cylinder of the second press unit, the first transfer drum having the normal and auxiliary set of grippers. When the auxiliary set of grippers is activated, the sheet is gripped at the trailing edge thereby to reverse the sheet for printing on the second side of the sheet in the second press unit. The sprocket chain is driven at a speed which is less than the peripheral speed of the first transfer drum so that the auxiliary set of grippers may remove the sheet more promptly from the conveyor and sprocket drum to avoid smearing of the printed side of the sheet. A vacuum type sprocket drum preserves accurate register of the sheet for gripping purposes and stationary vacuum plenums are provided for removing the sheet from the influence of the drum just prior to transfer from the conveyor to the first transfer cylinder.

10 Claims, 7 Drawing Figures fig.3.
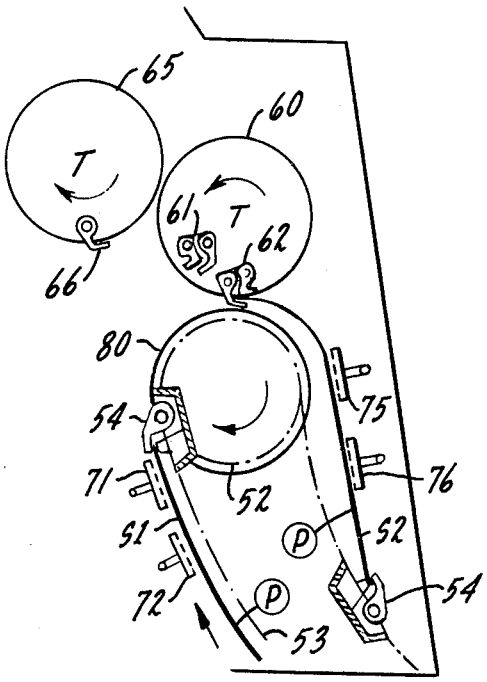
fig.4a.
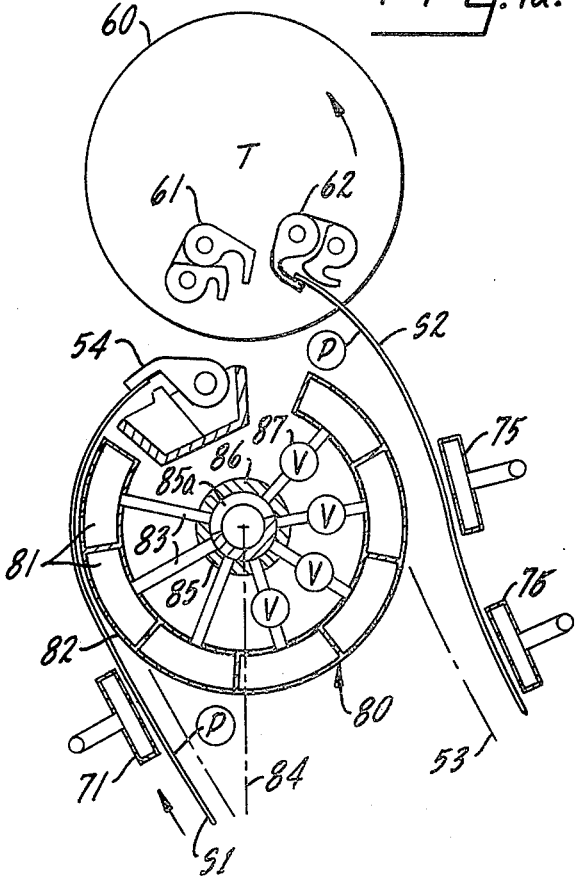
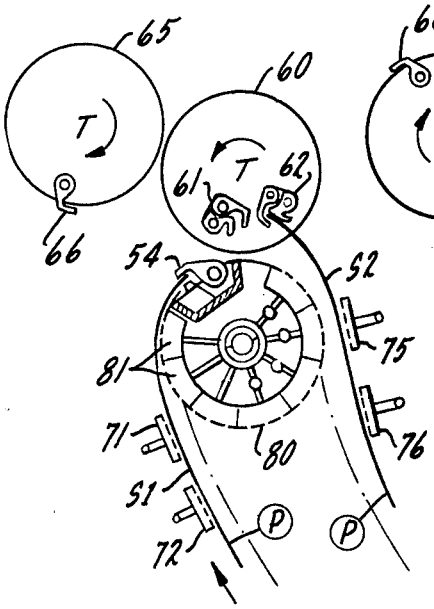
fig.4.
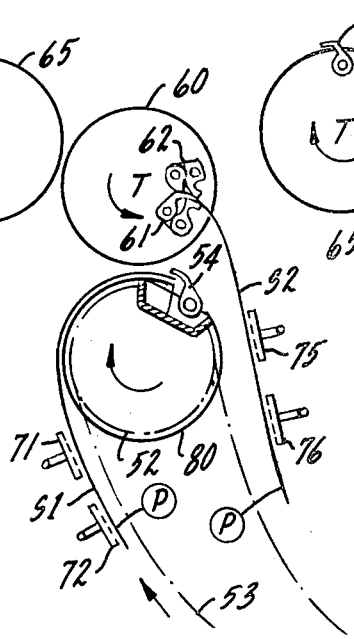
fig.5.
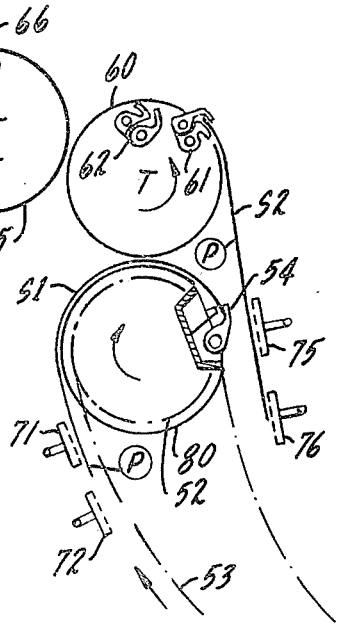
fig.6.

MULTICOLOR SHEET-FED PRINTING PRESS

The use of a conveyor chain to transfer a sheet from a first press unit to a second press unit has been known in the prior art, for example, as shown by British patent 255,733.

It has also been known to employ printing units which are conventionally coupled to one another and which are capable of printing on both front and back ("perfected" printing) or in multiple colors. An example of such printing press is shown in German patent 1,107,246. The capability of printing on one side only or on both front and back shall be referred to herein as "recto and verso" printing.

It is an object of the present invention to provide a printing press which is capable of recto and verso printing or multicolor printing, and in which the two press units which make up the total press may be located at some distance from one another interconnected by a chain type conveyor. In this connection it is an object to provide a printing press capable of recto and verso printing which avoids the smearing and other problems normally encountered when printing successively on opposite sides of the same sheet. It is a more specific object to provide a printing press capable of recto and verso printing in which there is a time delay between the printing on one side of the sheet and the printing on the other sufficient to allow the ink of the first printing to be fully absorbed into the fibers of the paper to substantially dry condition before the sheet is engaged for printing on the reverse side. The time delay between printing on the respective sides in no way limits the printing rate in each of the press units taken individually; consequently, it is an object to provide a printing press which is capable of producing high quality perfected printing at highest press speeds without risk of smearing the image on the first side.

It is more precisely one of the objects of the present invention to provide a printing press consisting of first and second printing units capable of printing on opposite sides of the sheet interconnected by a chain type conveyor in which the conveyor has a lineal speed which is less than the peripheral speed of the drums and cylinders in the presses and in which vacuum plenums, or braking devices, are provided to facilitate transfer of the sheet to the first transfer cylinder in the second press, in reversed relation, free of any smearing tendency.

Other objects and advantages of the invention will become apparent upon reading the attached detailed description and upon reference to the drawings in which:

FIGS. 3–6 are a set of stop motion views showing the function of the first transfer roller in securing reversal of the sheet as it enters the second press unit for printing on the second side thereof, the figures including vacuum braking means for the purpose of controlling the sheet.

FIG. 4*a* shows the sprocket drum of FIG. 4 somewhat enlarged.

While the invention has been described in connection with a preferred embodiment, it will be understood that we do not intend to be limited to the particular embodiment shown but intend, on the contrary, to cover the various alternative constructions which may be included within the spirit and scope of the appended claims.

Figure 1:
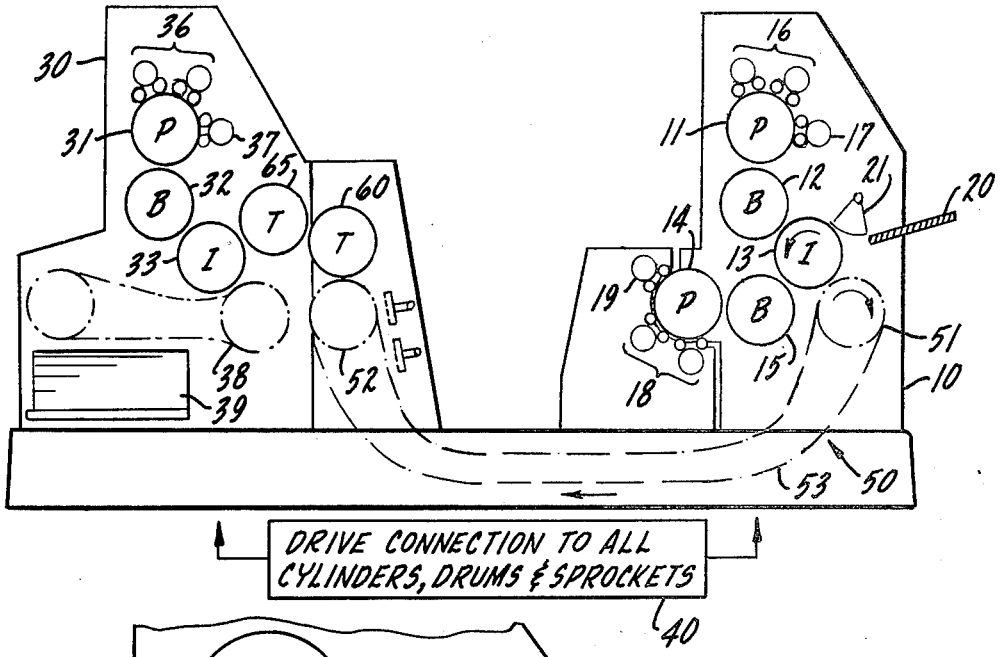
FIG. 1 is a diagrammatic side view of a printing press installation constructed in accordance with the present invention.

Turning now to FIG. 1 there is disclosed a printing unit 10 having a first plate cylinder 11, a first blanket cylinder 12 and an impression cylinder 13. Cooperating with the impression cylinder is a second plate cylinder 14 and associated blanket cylinder 15. The plate cylinder 11 has an inking system 16 and dampening system 17, while the plate cylinder 14 is provided with an inking system 18 and dampening system 19.

Sheets are fed into the press via a feed table 20, the sheets being transferred individually from a registered position on the feed table to the impression cylinder 13 by a swing-type gripper 21. It will be understood that the impression cylinder 13 is provided with a conventional set of grippers (not shown) which are synchronized with the swing gripper 21 for taking the leading edge of a sheet.

To accomplish additional printing, either on the same side of the sheet or on the reverse side, a second printing unit 30 is provided having a plate cylinder 31, blanket cylinder 32 and impression cylinder 33. The plate cylinder has an inking system indicated at 36 and a dampening system 37, corresponding to the systems in the first press unit. The impression cylinder 33, it will be understood, is similarly provided with a conventional set of grippers. A printed sheet is taken from the grippers of the impression cylinder 33 by a delivery conveyor 38, which is of conventional construction, and deposited by the conveyor upon a delivery pile 39 for stacking and periodic removal.

All of the cylinders, drums and sprockets are driven angularly in unison by drive connections which are not shown but which are generally indicated at 40.

In carrying out the present ivention a conveyor is provided for conveying sheets from the first printing unit to the second, the conveyor having an inlet sprocket for taking a sheet from the impression cylinder 13 in the first press unit and an outlet sprocket for delivering the sheet to the impression cylinder 33 in the second press unit, with first and second transfer drums being interposed between the outlet sprocket and the impression cylinder of the second press unit. The first transfer drum is equipped with grippers providing two separate modes of operation, depending upon whether printing is desired upon the same side or opposite side of the sheet. Thus, more specifically in accordance with the invention, the first transfer drum has a normal set of grippers for gripping the leading edge of the sheet at the outlet sprocket for printing on a first side of the sheet in the second printing unit and an auxiliary set of grippers for gripping the trailing edge of the sheet at the outlet sprocket, thereby to reverse the sheet for printing on the second side of the sheet and for promptly transferring the gripped edge to the normal grippers for subsequent handling. In this way the press assembly is made highly flexible, being capable of printing successively, with slight time delay between the impressions, on the same side of the sheet where perfected printing is required.

Thus, referring again to FIG. 1, a chain type conveyor 50 is provided having an inlet sprocket 51 associated with the impression cylinder 13 and an outlet sprocket 52 which is associated with, but not directly coupled to, the impression cylinder 33 in the second unit. Trained about the sprockets is a conveyor chain 53 having sets of grippers 54 mounted thereon (see also FIG. 2) in evenly spaced relation. The means for opening and closing the grippers 54 will be understood to be conventional.

Arranged adjacent the outlet sprocket 52 is a first transfer drum 60 having a normal set of grippers 61 capable of gripping the leading edge of a sheet at the sprocket 52, and an auxiliary set of grippers 62 capable of gripping the trailing edge of a sheet for reversal purposes, as will be described. From the first transfer drum 60 the sheet is transferred to a second transfer drum 65 having a set of grippers 66 which act, in turn, to transfer the sheet to conventional grippers (not shown) at the surface of the impression cylinder 33.

In the operation of the press in its first mode, that is, where both of the printing press units 10, 30 contribute toward multicolor printing on a single side of the sheet, the auxiliary grippers 62 on the first transfer drum are retracted and silenced, and the normal set of grippers 61 is effective to transfer a sheet from the outlet sprocket 52 to the second transfer drum 65.

Figure 2:
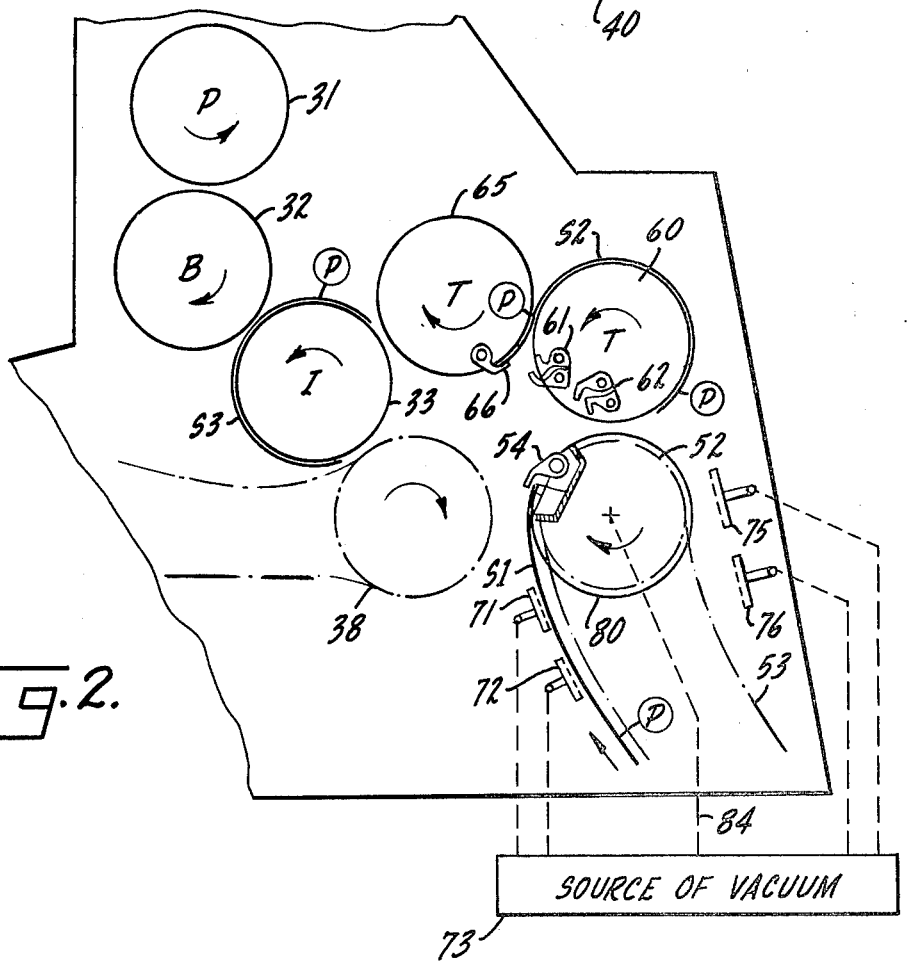
FIG. 2 is an enlarged diagrammatic side view of a portion of the second press unit illustrated in FIG. 1 utilized for multicolor printing on the same side of the sheet.

Thus, referring to FIG. 2, a sheet S1 is shown having its leading edge gripped by a gripper 54 on the conveyor chain 53. The printed side of the sheet, which has been previously printed in the first press unit, is indicated by the Ⓟ. Two subsequent positions of the sheet are indicated at S2 and S3.

Accordingly, when the sheet S1 is transferred into engagement with the first transfer cylinder 60, the leading edge of the sheet is released by the set of grippers 54 and more or less simultaneously captured by the set of grippers 61. The sheet passes counterclockwise about the first transfer cylinder 60 following which the leading edge of the sheet is released by gripper 61 and captured by grippers 66 on the second transfer drum 65. From the second transfer drum the leading edge of the sheet is picked up by grippers on the impression cylinder 33 which passes the sheet, with its printed side out, into printing engagement with the blanket on the blanket cylinder 32.

The resulting sheet, printed on one side only, is then passed to the delivery conveyor 38, which is of conventional construction, and which serves to drop the sheet on the delivery pile 39, from which the collected sheets are periodically removed.

For the purpose of controlling flutter of the sheet as it passes along the conveyor chain at the region of approach to the outlet sprocket 52, vacuum brakes 71, 72 are provided in the form of apertured plenums, or vacuum boxes, which are connected to a source of vacuum 73 and which serve to produce a slight drag on the unprinted side of the sheet. The vacuum boxes may, for example, be of the construction shown in German Publication Specification DAS 2,305,132.

Because of the slight time delay between the printing of the sheet in the first press unit and the printing of the sheet in the second press unit, by reason of transport on the conveyor chain between the two units, and which may be on the order of one to several seconds, the ink applied at the first printing unit has time to be fully absorbed into the paper. It is not until engagement of the sheet with the second transfer drum 65 that the printed side of the sheet is engaged. Since by this time the sheet is almost in dry condition, any possibility of smearing of the printed image is avoided and there is no necessity for using a dryer.

In carrying out the present invention, and as illustrated in FIGS. 3–6, the auxiliary set of grippers 62 on the first transfer drum, which are silenced during normal transfer, have provision for swinging into activated position for gripping the trailing edge of a sheet carried by the conveyor and for passing the trailing edge of the sheet to the normal set of grippers 61 thereby to reverse the sheet for printing of the second side of the sheet, and the conveyor chain is driven at a speed which is slightly less than the peripheral speed of the first transfer drum so that the auxiliary grippers thereon may, with the assistance of vacuum plenums to be discussed, transfer a sheet from the conveyor without smearing the printed side. To achieve the required reduction in conveyor speed, which may be on the order of ten percent, the sprockets 51, 52 have a diameter which is proportionately less than the associated cylinders and drums.

For a more detailed disclosure of a transfer drum having a normal set of grippers 61 and an auxiliary set of grippers 62 for gripping the trailing edge of a sheet, and with means for transferring the gripped edge to the normal set of grippers in reversed relation, reference is made to Gegenheimer et al., U.S. Pat. No. 2,757,610 on Sheet Handling Mechanism and Method For Multi-Color Perfector Press which issued Aug. 7, 1956 and Weisgerber, U.S. Pat. No. 3,796,154 on Sheet Handling Apparatus For a Multi-Color Perfector Press which issued Mar. 12, 1974.

It will suffice for the present to say that when the transfer drum 60 is operated in its auxiliary mode the auxiliary grippers 62 are in active position as illustrated in FIG. 3. In this figure, as in the earlier figures, S1 and S2 indicate successive positions in the path of movement of a sheet through the press unit. A sheet first occupies the position S1 at the region of approach to the outlet sprocket 52, with the sheet subsequently passing around to position S2, at which time the tail of the sheet is gripped by the auxiliary grippers 62. Conventional means (not shown) are employed to release the gripper 54 on the conveyor chain so that the sheet is free to reverse its direction of movement as it is pulled "tail first." As the transfer drums continue to rotate in the direction of the arrows, the normal grippers and auxiliary grippers 61, 62 rock toward one another as shown in FIG. 4. Upon additional rotation of the transfer drums the formerly trailing edge of the sheet S2 is transferred to the normal set of grippers 61 as shown in FIG. 5, with the trailing edge of the sheet now becoming the leading edge. Following the transfer the normal set of grippers 61 rocks into the extended position illustrated in FIG. 6 in readiness for transfer of the sheet to the gripper 66 on the second transfer drum.

The effect of such reversal may be contrasted with the first mode of operation shown in FIG. 2. In absence of reversal, the side of the sheet printed in the first press unit faces inwardly on the conveyor chain, outwardly on the first transfer drum, inwardly on the second transfer drum, and outwardly on the impression cylinder 33 so that printing in the second press unit occurs on the same side of the sheet.

However, when the device operates in its reversing mode, with the auxiliary grippers 62 effective, the side of the sheet which has been printed in the first press unit faces inwardly on the first transfer drum, outwardly on the second transfer drum and inwardly on the impression cylinder 33, so that the second side of the sheet is printed in the second press unit, with the result that the sheets which are deposited upon the delivery pile are perfected, that is, printed on both sides.

In accordance with one of the features of the present invention, a vacuum brake is provided along the conveyor at the region of departure of the conveyor chain from the outlet sprocket 52 for engaging the presented outside (unprinted) surface of the sheet so as to brake the sheet and control fluttering of the sheet upon its reversal when the trailing edge is gripped by the auxiliary set of grippers. This second vacuum brake, consisting of perforated plenums 75, 76, is energized by the same source of vacuum 73.

It will be seen, then, that the sheet is under precise control both in the region of approach to the outlet sprocket 52 and in the region of departure from the outlet sprocket. On approach, the presented outer surface of the sheet is brought into engagement with the vacuum plenums 71, 72 by reason of the sheet's tendency to swing outwardly as a result of centrifugal force as the sheet is drawn by the gripper around the periphery of the sprocket. This controls fluttering on approach. Upon departure of the sheet, as illustrated in FIGS. 3 and 4, not only is centrifugal force effective to bring the tail of the sheet into contact with the vacuum brake 75, 76, but the auxiliary grippers 62 on the transfer drum, gripping the tail of the sheet, cause the tail to be shifted outwardly with positive action. The fact that the drum 60 is operating at a faster speed than the conveyor results in more prompt separation of the tail of the sheet from the conveyor, thereby reducing the tendency of the tail of the sheet to smear against the surface of the drum 80 (to be described). Once gripped, the sheet is kept under precise control by the drag of the vacuum brakes 75, 76 until the sheet is drawn clear of the latter.

In addition to the control of the sheet exercised by the vacuum brakes 71–76, the transfer drums 60, 65 perform a stabilizing function in that the sheet, in both of the modes of operation, is wrapped smoothly about the drums in S configuration insuring that the sheet is in a smooth and stabilized condition in readiness for transfer to the grippers normally provided on the impression cylinder 33. This combination, with the sprocket drum to be described, insures that the printed impression occurring in the second press unit will be precisely in a desired position of register both for "same side" multicolor printing and for "two side" or perfected printing, at the selection of the press operator.

In accordance with one of the detailed features of the invention, a sprocket drum 80 is provided which is coaxial with the outlet sprocket 52 having a plurality of peripheral vacuum chambers extending the length of the drum and arranged side by side, communicating with orifices on the surface of the drum, the chambers being coupled to the source of vacuum 73 during a predetermined portion of the rotative cycle for acting upon the sheet as it is turned about the outlet sprocket.

Thus the sprocket drum has a series of compartments 81 which extend axially the entire length of the drum and which are in communication with a pattern of surface apertures 82. Vacuum is applied to the chambers through respective radially oriented conduits 83.

For the purpose of "commutating" the application of vacuum to the radial conduits 83, vacuum is supplied via a line 84 to a central tube 85 which is enclosed by a rotary sleeve 86 supporting the inner ends of the conduits, with the tube having a notch 85a so that communication is established with the conduits only during the time that each conduit rotates through a selected portion of its rotative cycle. As shown, each of the conduits 83 and its associated chamber 81 have vacuum applied only during the "top half" of the circle of rotation. This tends to hold the sheet flat and in a precisely registered position on the sprocket drum during the time that the sheet is being rotated by the sprocket.

As a still further feature, valves, such as that indicated at 87, are interposed in the individual conduits 83 so that certain ones of the chambers may, if desired, be completely silenced as far as application of vacuum is concerned to accommodate the mechanism to a shorter sheet length.

The structure, illustrated in FIG. 4a, preferably includes provision for rocking adjustment of the tube 85 thereby to control the phase of the sprocket drum 80 over which vacuum is applied from the drum to the sheet. By causing each sheet to occupy a precisely registered position on the surface of the drum 80, the tail of the sheet is accurately phased for registered reversal by the auxiliary set of grippers 62. In the reversal mode, when the sheet passes on the downstream side of the sprocket drum 80 and the vacuum at the surface of the drum is commutatively released, the vacuum plenums 75, 76 engage the unprinted backside of the sheet and hold the sheet away from the surface of the drum as illustrated in FIG. 3. The plenums apply braking force as the sheet is pulled, tail first, by the auxiliary grippers 62 as illustrated in FIGS. 4 and 5. Transfer of the sheet from the drum 80 into contact with the vacuum plenums 75, 76 avoids smearing of the printed face of the sheet by the drum surface as the velocity and direction of movement of the sheet are changed.

The press is not only capable of quality printing in different modes at high speed, but capable of achieving superior results using a wide variety of paper stock, even stock which is limp and thin and not well suited to reversal.

What we claim is:

1. In a multicolor sheet fed printing press installation, the combination comprising, a first press unit having means including a first impression cylinder for printing on one side of a sheet, a second press unit having means including a second impression cylinder for printing on one side of a sheet, a conveyor comprising an endless conveyor chain having grippers and trained about an inlet sprocket in the first press unit for taking a sheet from the first impression cylinder and trained about an outlet sprocket in the second press unit for delivering the sheet to the second impression cylinder, first and second transfer drums interposed in series between the outlet sprocket and the second impression cylinder for controlling the feeding of the sheets to the latter, the first transfer drum having (1) means including a normal set of grippers for gripping the leading edge of the sheet at the outlet sprocket for printing on a first side of the sheet in the second press unit, and (2) means including an auxiliary set of grippers for gripping the trailing edge of the sheet at the outlet sprocket and for transferring the gripped edge to the normal set of grippers, thereby to reverse the sheet for printing on the second side of the sheet in the second press unit, and means for receiving sheets from the second impression cylinder and for delivering them at a delivery point.

2. The combination as claimed in claim 1 in which the sprockets are rotated at the angular speed of the transfer drums but have a pitch diameter which is slightly less than the diameter of the transfer drum.

3. The combination as claimed in claim 1 in which the conveyor chain has grippers evenly spaced thereon departing and arriving in synchronism with the rotation of the respective impression cylinders, the chain being driven at a speed which is slightly less than the peripheral speed of the transfer drums, and the chain having a length sufficient to produce a time delay between printing in the first press unit and printing in the second unit sufficient to produce absorption of the ink of the first printing to substantially dry state before the sheet is acted upon in the second press unit thereby to prevent smearing of the first-printed image.

4. The combination as claimed in claim 1 in which the surface of the sheet which has been printed by the first press unit faces inwardly on the conveyor chain, a first vacuum brake provided along the conveyor chain at the region of approach to the outlet sprocket for engaging the presented outside surface of the sheet for controlling flutter of the sheet engaged by the leading edge and including a second vacuum brake provided along the conveyor at the region of departure of the conveyor chain from the outlet sprocket for engaging the presented outside surface of the sheet so as to control fluttering of the sheet upon its reversal when the trailing edge thereof is gripped by the auxiliary set of grippers.

5. The combination as claimed in claim 1 in which the outlet sprocket has a coaxially connected sprocket drum, the sprocket drum having a plurality of peripheral vacuum chambers extending the length of the drum and arranged side by side communicating with orifices on the surface of the drum, a source of vacuum, and means for coupling the chambers to the source of vacuum during a predetermined portion of the rotative cycle for holding a conveyed sheet in a predetermined registered position with respect to the sprocket drum and sprocket.

6. The combination as claimed in claim 5 in which the outlet sprocket has a pitch diameter which is slightly less than the diameter of the sprocket drum.

7. The combination as claimed in claim 5 in which the coupling means includes conduits connected to the respective chambers, means for commutatively connecting the conduits to the source of vacuum, and valves interposed in at least some of the conduits for silencing of selected chambers depending upon the length of the sheets being handled.

8. In a multicolor sheet fed printing press installation, the combination comprising, a first press unit having means including a first impression cylinder for printing on one side of a sheet, a second press unit having means including a second impression cylinder for printing on one side of a sheet, a conveyor comprising an endless conveyor chain having grippers and trained about an inlet sprocket in the first press unit for taking a sheet from the first impression cylinder and trained about an outlet sprocket in the second press unit for delivering the sheet to the second impression cylinder, a transfer drum interposed between the outlet sprocket and the second impression cylinder for controlling the feeding of sheets to the latter, the transfer drum having (1) means including a normal set of grippers for gripping the leading edge of the sheet at the outlet sprocket for printing on a first side of the sheet in the second press unit, and (2) means including an auxiliary set of grippers for gripping the trailing edge of the sheet at the outlet sprocket and for transferring the gripped edge to the normal set of grippers, thereby to reverse the sheet for printing on the second side of the sheet in the second press unit, means for driving the conveyor chain at a speed which is slightly less than the peripheral speed of the transfer drum, and means for receiving sheets from the second impression cylinder and for delivering them at a delivery point.

9. In a multicolor sheet fed printing press installation, the combination comprising a first press unit having means including a first impression cylinder for printing on one side of a sheet, a second press unit having means including a second impression cylinder for printing on one side of a sheet, a conveyor comprising an endless conveyor chain having grippers and trained about an inlet sprocket in the first press unit for taking a sheet from the first impression cylinder and trained about an outlet sprocket in the second press unit for delivering the sheet to the second impression cylinder, a sprocket drum concentric with the outlet sprocket, first and second transfer drums interposed in series between the sprocket drum and the second impression cylinder for controlling the feeding of sheets to the latter, the first transfer drum having (1) means including a normal set of grippers for gripping the leading edge of the sheet from the sprocket drum for printing on a first side of the sheet in the second press unit and (2) means including an auxiliary set of grippers for gripping the trailing edge of the sheet from the sprocket drum and for transferring the gripped edge to the normal set of grippers, thereby to reverse the sheet for printing on the second side of the sheet in the second press unit, and a vacuum plenum on the downstream side of the sprocket drum and spaced from the sprocket drum for lifting the sheet clear of the sprocket drum and for braking the movement thereof incident to the gripping of the trailing edge of the sheet by the auxiliary set of grippers.

10. The combination as claimed in claim 9 in which the sprocket drum is perforated and includes means for applying vacuum through the perforations over an arc of the drum preceding the location of the vacuum plenum to keep the sheet in accurate register on the drum until removed by the auxiliary set of grippers.

* * * * *